United States Patent [19]

Schaeffer et al.

[11] 3,949,499

[45] Apr. 13, 1976

[54] REMOVABLE TANK IRON

[75] Inventors: Robert L. Schaeffer, Leroy, N.Y.; Charles A. Balchunas, Alta Loma, Calif.

[73] Assignee: General Electric Company, Bridgeport, Conn.

[22] Filed: Dec. 19, 1974

[21] Appl. No.: 534,215

[52] U.S. Cl. ..... 38/77.3

[51] Int. Cl.[2] ..... D06F 75/06

[58] Field of Search ..... 38/77.3, 77.1, 77.5, 77.8, 38/77.81, 77.83

[56] References Cited

UNITED STATES PATENTS

| | | | |
|---|---|---|---|
| 3,175,316 | 3/1965 | Foster et al. | 38/77.3 |
| 3,413,741 | 12/1968 | Schwartz et al. | 38/77.3 |

*Primary Examiner*—Patrick D. Lawson

*Attorney, Agent, or Firm*—John F. Cullen; George R. Powers; Leonard J. Platt

[57] ABSTRACT

An iron with fluid handling means and a removable tank assembly that has a tank support and a conduit that extends from the fluid handling means into the tank when it is disposed on the support. Means are provided to fill the tank when removed and a pliable plug means is disposed in the tank and split to accept the conduit therethrough in a sealing relation permitting fluid flow from the tank to the handling means so that the conduit pierces the pliable plug in a tight seal when the tank is placed in position and the plug seals itself when the conduit and tank are separated for filling.

12 Claims, 5 Drawing Figures

REMOVABLE TANK IRON

FIELD OF THE INVENTION

The invention herein pertains to an electric flatiron and, more particularly, to a steam iron with an easily removable snap-in-snap-out water tank that may be removed from the iron for filling and snapped back into position on the iron to automatically establish a leak proof fluid connection which seals itself when the iron and tank are separated for filling.

DESCRIPTION OF THE PRIOR ART

The present invention is directed to newer developments in iron technology that use plastic or flexible parts either alone or in combination with usual metallic elements and which may be easily replaceable or, in the case of steam irons, where the tank may be removed for replacement or refilling. Prior art devices have been confined primarily to easy replacement for repairability such as disclosed in U.S. Pat. No. 3,413,741 illustrating a take-apart iron where one or more parts may be removed without the use of tools and replaced if defective. Additionally, older traveling irons as in U.S. Pat. No. 2,737,737 illustrate a removable water tank to convert the iron from dry to steam which tank may be removed and filled separately and attached to the iron. This is typical in light weight travel irons and the tank is generally screwed onto a suitable external fitting to automatically open a valve permitting water flow. The tank also serves as a heel rest in this device. A similar later version in patent 3,685,182 discloses a removable water tank for a travel iron which is arranged so it automatically shuts off steaming when the iron is placed in the heel rest position. Again, the water tank is screwed onto the iron to automatically open a connecting valve. Other similar prior art illustrate removable water tanks all of which generally require metallic mechanical connections between the tank and iron requiring the user to screw or bolt the tank and iron together. The present invention improves on a fluid using iron by which the tank may be easily attached and detached by nothing more than pushpull motion that automatically seals the tank when removed regardless of where the connection is and automatically makes the connection in a positive fluid sealing connection when the tank is snapped onto the iron.

SUMMARY OF THE INVENTION

Briefly described, the present invention is directed to an iron, generally a steam iron but not so limited, that has fluid handling means therein for spraying or steaming with a removable tank assembly for the iron. A tank support is provided on the iron and conduit means from the fluid handling means extends into the tank when it is disposed on the support. Means are provided to fill the tank when it is removed and a pliable plug means is provided in the tank, preferably with a flower-petal or cross split construction, to accept the conduit therethrough in sealing relation when the plug is pushed onto the conduit permitting fluid flow from the tank to the handling means for steam or spray whereby the conduit and plug form a fluid tight seal when the tank is connected and the plug automatically closes and seals itself when the conduit and tank are separated. Thus, the main object of the invention is to provide a simple and easily removable tank assembly that attaches to the iron in a hypodermic hollow needle-type connection that prevents leakage when the tank is detached for filling or snapped into position on the iron for using.

DESCRIPTION OF THE PREFERRED EMBODIMENT

Figure 1:
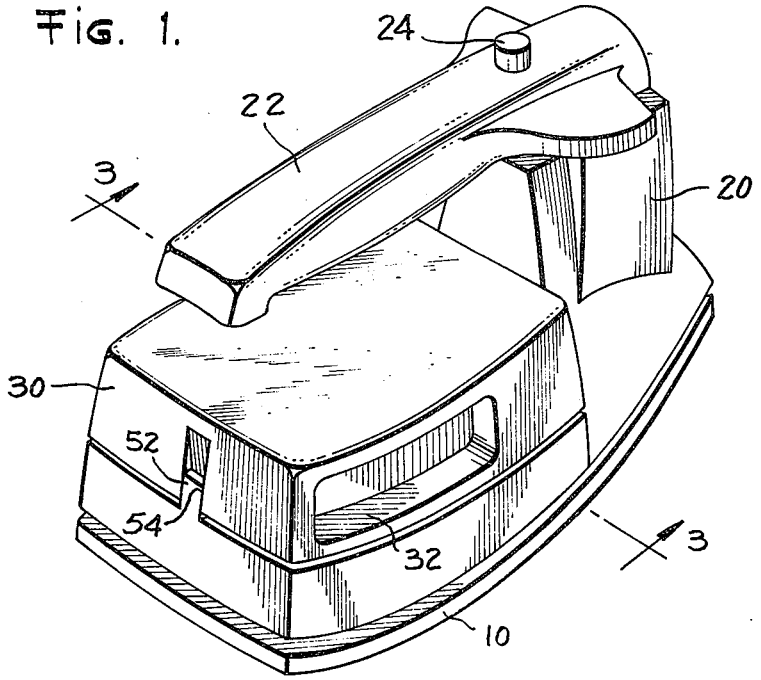
FIG. 1 is a perspective of an open-handle iron showing the tank in position.
Figure 3:
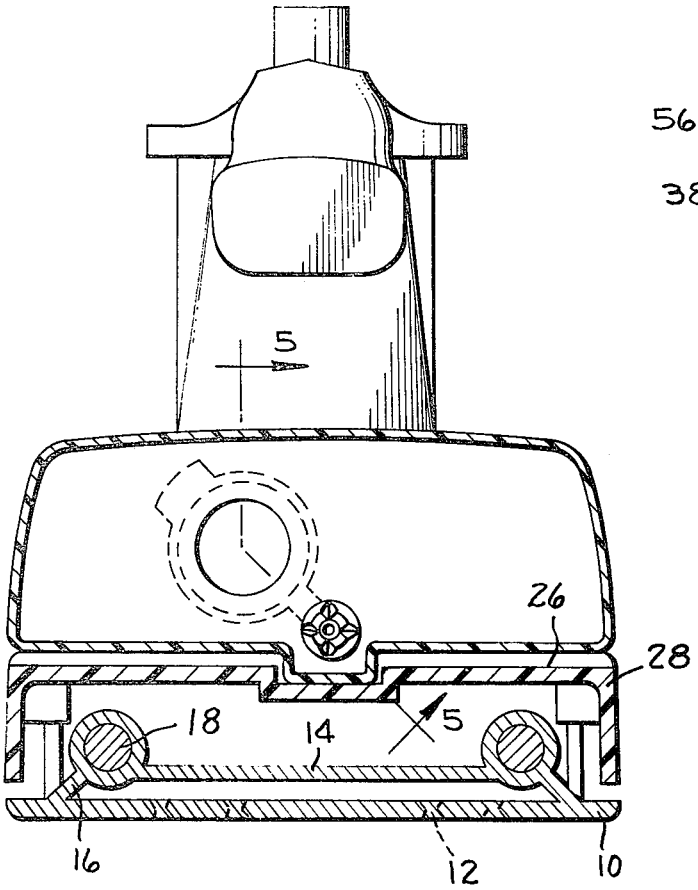
FIG. 3 is an elevation view partly in section taken on the line 3—3 in FIG. 1.

The invention is described in connection with a steam iron for convenience, although it is applicable to any fluid that may be used with an iron whether to spray liquid starch or steam or water. As will be apparent, the invention is particularly applicable to an open handled iron although it is not so limited. With an open handle iron the removable tank construction is a simple push-pull arrangement to snap the tank in and out. Referring to FIGS. 1 and 3, there is shown an open-handle iron comprising a soleplate 10 that may have suitable steam ports 12 with or without a spray all in a well-known manner. As shown in FIG. 3, soleplate 10 is a thin wrought member to which a coverplate 14 may be fastened by heat conduction means such as welded legs 16 with attached heating element 18, the heat being transferred by conduction through leg 16 to thin soleplate 10. This thin soleplate construction is the subject of copending application Ser. No. 491,463 filed July 24, 1974 of common assignment. Any conventional soleplate construction may be used and the one shown is merely for convenience to illustrate a thin construction. Open handle 22 is provided suitably connected at the forward portion. Disposed within the forward portion of the iron is conventional fluid handling means such as metering water valve structure for making steam or a spray structure, or both, mounted in and forming part of pedestal 20 or the vertical portion of the handle 22 and which handling means may be actuated by suitable button 24 all as well-known in the art.

Figure 2:
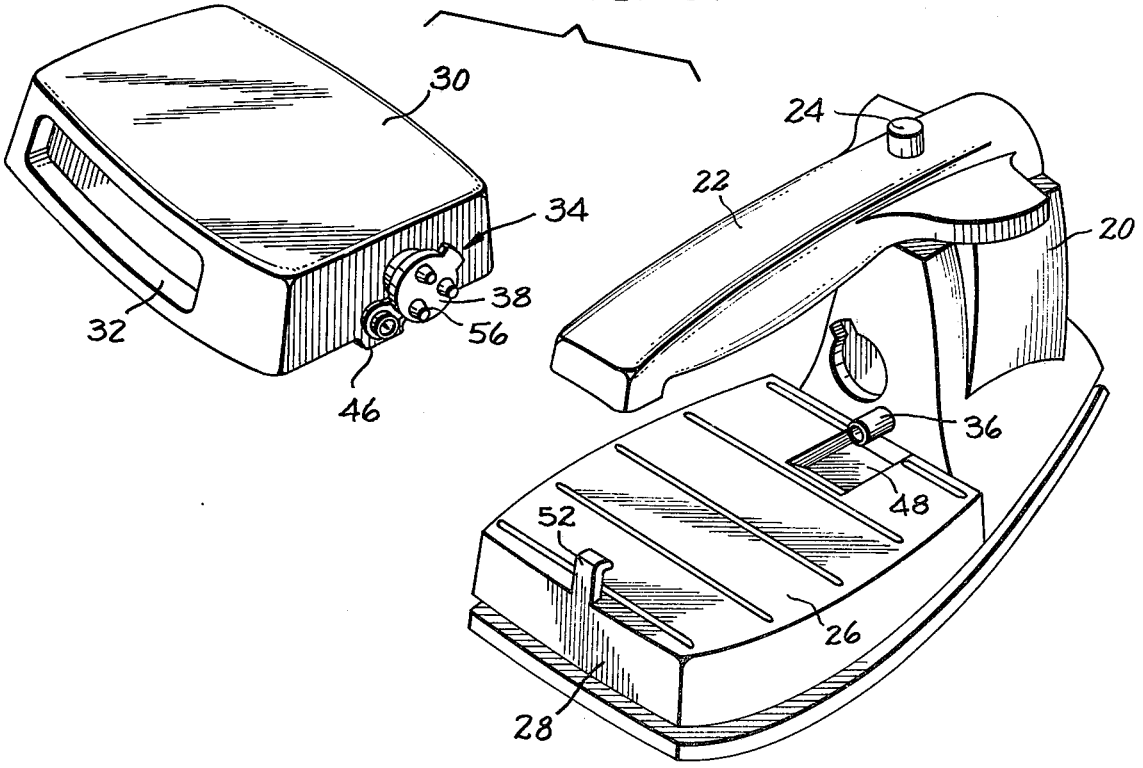
FIG. 2 is an exploded perspective showing the tank and iron separated.

In accordance with the invention, when an iron of the open-handle version is used, it makes a convenient arrangement to support a removable water tank above the soleplate under the handle and to this end, the aft portion of the iron is formed with a substantially flat deck 26 that may be the top portion of skirt 28 extending down to the soleplate to enclose the soleplate assembly. This deck is designed to support a removable water tank 30 in a manner to be described. The parts are generally coextensive around the edges so tank 30, in supported position, blends well with the iron as shown in FIG. 1. Any suitable hand grips 32 may be provided in the side of the tank for easy handling. The tank may be metallic or more likely plastic, easily formed in one operation, and transparent or translucent to see the fluid level therein as is well-known. Similarly, the skirt 28 may also be metallic or plastic. The tank is designed to be easily removed from the iron for filling through a suitable opening generally indicated at 34 and preferably disposed on the front wall as shown in FIG. 2 although it could clearly be provided in other walls of the tank.

Figure 4:
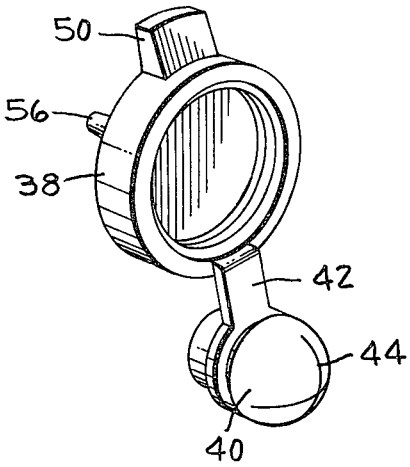
FIG. 4 is a perspective of a typical cap-plug.
Figure 5:
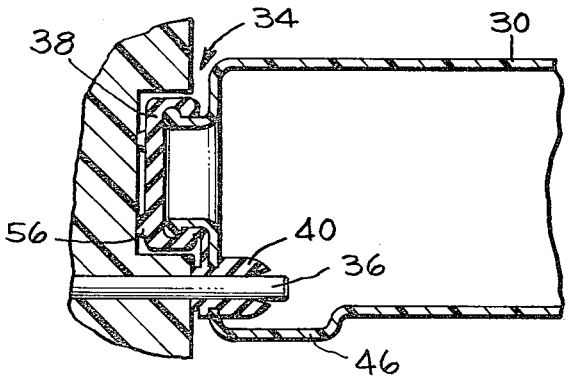
FIG. 5 is a partial cross-section taken on line 5—5 of FIG. 3.

In order to easily attach and detach the tank for filling without leakage, a unique hypodermic hollow needle-type arrangement is provided to ensure fluid tight connections at all times. To this end, the forward pedestal portion 20 of the iron has an open-ended conduit 36 that extends from the water handling means within the pedestal back over the deck as shown in FIG. 2. It is disposed low along the deck so that it may withdraw the maximum water from the tank 30 when in position as will be apparent. In order to connect the tank interior to the conduit, there is provided a separate member, that is preferably a soft flexible rubber-like elastomer member conveniently formed in one piece of a flexible cap 38 and plug 40, joined together by a connecting hinge 42, the entire member as shown in FIG. 4 preferably being a single integral resilient component. For connection with conduit 36, pliable plug 40 is formed to have an opening to accept conduit 36. As shown, the plug is split to have at least a single (FIG. 2) or any suitable number of cuts 44 (FIG. 4) or even a tubular or passage-like opening of the general form of FIG. 5, all of which type openings are aligned to be pierced by pushing on to open-ended conduit 36 to open like a flower petal or operate like a hypodermic needle and accept the conduit 36 therethrough in a fluid tight seal as shown in FIG. 5 for flow from the tank to the handling means. Similarly, plug 40 seals itself when withdrawn. Thus, a resilient component with a self-closing opening of any form or shape is intended by the term "split" in the claims and the cross-split of FIG. 4 is merely a preferred form. Other equivalent sealable valve means such as abutting plastic surfaces, e.g. nylon, may be used to connect the conduit and tank interior and such are intended by the word "sealable" as used in the claims. The conduit shown in the preferred form thus extends into the bottom of tank 30 and may be in a small recessed portion 46 that nests in corresponding recess 48 in the deck to locate the tank against lateral and, with the conduit/plug connection, against vertical motion. Since a fluid-tight connection is necessary, the plug 40 is fixed in the front wall of the tank in any suitable manner such as a grommet-like fastening as shown in FIG. 5. For convenience, the fill opening and plug are separate and adjacent one another with the flexible cap 38 being captured by a deformable web in the form of hinge 42 to anchor and locate the cap over opening 34 whereby the cap may be easily snapped into a fluid-tight connection over the opening as shown in FIG. 5. A tab 50 is provided for removing the cap to fill the tank. In order to separately lock the tank on the support and locate the heel portion of the tank, a suitable locking means such as deformable clamping tab 52 is provided on the skirt 28 and the tank has a matching recess 54 so the tank may be easily snapped into and out of position by a single means disposed to hold the heel portion down and lock the tank against vertical movement and, with recess 54, also lock it from lateral movement with the parts being formed to press the tank forward against pedestal portion 20. For a snug fit of the tank in position, soft rubber-like elastomer or plastic cap 38 has integral deformable projections 56 that bear against the vertical portion of the handle at pedestal 20 to serve as springs which compress or squash upon assembly of the tank and bias the tank away from the conduit against the press of locking means of tab 52 at the heel of the tank to secure the tank with the conduit through the plug 40.

Thus, the simplified tank assembly is a push-pull arrangement by which the tank may be simply removed from the deck of the iron by lifting it out, whereupon the cross split plug 40 automatically seals the tank against loss of fluid and the tank may be filled elsewhere by opening cap 38. The cap is then snapped on, the tank placed on the deck with conduit 36 automatically opening and sealing into soft plug 40 of the cap structure to provide a fluid pickup means or link with the fluid handling means of the iron. The simple essentially two-part structure of the cap and tank assembly of FIG. 2 pushes easily and quickly together with latching tab 52 firmly and snugly locating the tank in position on the iron. Of course, the tank is easily replaceable by the user as a separate part if repairs are necessary. Its primary function with the structure described is the easy snap together or push-pull function permitting removal for fill or refill while automatically sealing against leakage.

While we have described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

We claim:

1. An electric flatiron with a handle, soleplate and with fluid handling means having a removable tank assembly comprising:

a tank support on said iron, conduit means from said fluid handling means extending into said tank when disposed on said support, means to fill said tank when removed, and pliable plug means in said tank split to accept said conduit therethrough in sealing relation for fluid flow from said tank to the handling means, whereby said conduit pierces the pliable plug in a fluid tight seal when the tank is connected and the plug seals itself when the conduit and tank are separated.

2. Apparatus as described in claim 1 having separate clamp means to lock said tank in position on said support.

3. Apparatus as described in claim 2 wherein said support is a substantially flat deck under the iron handle above the soleplate.

4. Apparatus as described in claim 3 wherein said clamp means is a single means to lock said tank from vertical and lateral movement.

5. Apparatus as described in claim 4 wherein said means to fill said tank is a flexibly-capped fill opening with the pliable plug separate and disposed in a wall of said tank, and said plug and flexible cap are connected by a deformable web therebetween.

6. A steam iron with an open vertically connected handle, soleplate and water handling means having a removable tank assembly comprising:

a substantially flat deck under said open handle above the soleplate, an open-ended conduit from said water handling means extending over said deck, detachable tank means having a fill opening in a wall thereof and flexible cap means adapted to seal said opening, separate pliable plug means secured in a wall adjacent the fill opening, said plug being split and aligned to accept said conduit therethrough in sealing relation for water flow from the tank to the handling means, hinge means connecting the cap and plug anchoring and locating said cap, and locking means securing said tank in position on said deck with the conduit through said plug into said tank.

7. Apparatus as described in claim 6 having means biasing said tank away from said conduit.

8. Apparatus as described in claim 7 wherein said locking means is disposed to secure said tank from both vertical and lateral movement.

9. Apparatus as described in claim 7 wherein said locking means is disposed at the heel of said iron to secure said tank from both vertical and lateral movement and press said tank toward said conduit.

10. Apparatus as described in claim 7 wherein said biasing means includes integral deformable projections on said cap bearing against the vertical portion of said handle and said locking means is a deformable tab at the heel of said iron disposed to lock the tank against vertical and lateral motion and press said tank opposite to said biasing means.

11. A water tank for an electric flatiron having a tank receiving base and fluid handling means, said tank comprising:

a closed fluid containing means formed to rest on said base, means to fill said tank, and pliable plug means in said tank split to accept a filling conduit therethrough in sealing relation for fluid flow from said tank to the handling means, whereby the pliable plug means may be pierced by the filling conduit in a fluid tight seal when the tank is connected to the iron and the plug seals itself when the tank is removed from the iron.

12. A tank as described in claim 11 wherein the pliable plug is secured grommet-like to a tank wall and anchors a connected flexible cap for closing the filling means.

* * * * *